US008184133B2

(12) United States Patent
Morvan et al.

(10) Patent No.: US 8,184,133 B2
(45) Date of Patent: May 22, 2012

(54) METHODS FOR SEQUENTIAL COLOR DISPLAY BY MODULATION OF PULSES

(75) Inventors: Patrick Morvan, Laille (FR); Jonathan Kervec, Paimpont (FR); Julien Thollot, Betton (FR)

(73) Assignee: Thomson Licensing, Issy-les-Moulineaux (FR)

( * ) Notice: Subject to any disclaimer, the term of this patent is extended or adjusted under 35 U.S.C. 154(b) by 491 days.

(21) Appl. No.: 12/227,666

(22) PCT Filed: May 24, 2007

(86) PCT No.: PCT/EP2007/055065

§ 371 (c)(1), (2), (4) Date: Sep. 22, 2009

(87) PCT Pub. No.: WO2007/137994

PCT Pub. Date: Dec. 6, 2007

(65) Prior Publication Data

US 2010/0026613 A1 Feb. 4, 2010

(30) Foreign Application Priority Data

May 30, 2006 (FR) ..... 06 04798

(51) Int. Cl.
*G09G 5/10* (2006.01)

(52) U.S. Cl. ..... 345/690; 345/77; 345/82; 345/87

(58) Field of Classification Search ..... 345/32, 345/76–77, 87–102, 204, 214, 694–698, 345/581, 589, 600, 619, 690; 349/104–108; 348/69, 268–269, 500–503, 557, 742, 759; 382/162, 167, 211, 274; 358/509, 512, 518
See application file for complete search history.

(56) References Cited

U.S. PATENT DOCUMENTS

| | | | | |
|---|---|---|---|---|
| 6,392,620 | B1 * | 5/2002 | Mizutani et al. | 345/88 |
| 6,570,554 | B1 | 5/2003 | Makino et al. | |
| 7,027,013 | B2 * | 4/2006 | Ouellete et al. | 345/76 |
| 7,248,244 | B2 * | 7/2007 | Akiyama | 345/102 |
| 7,486,730 | B2 * | 2/2009 | Van Dijk et al. | 375/240.01 |
| 7,746,294 | B2 * | 6/2010 | Lee et al. | 345/30 |
| 8,077,185 | B2 * | 12/2011 | Selbrede et al. | 345/589 |
| 8,115,776 | B2 * | 2/2012 | Selbrede et al. | 345/589 |
| 2004/0217932 | A1 | 11/2004 | Nally et al. | |

FOREIGN PATENT DOCUMENTS

| | | |
|---|---|---|
| EP | 1434194 | 6/2004 |
| EP | 1521480 | 4/2005 |
| EP | 1717791 | 11/2006 |

OTHER PUBLICATIONS

Search Report Dated Apr. 4, 2008.

* cited by examiner

*Primary Examiner* — Nitin Patel
*Assistant Examiner* — Mansour M Said
(74) *Attorney, Agent, or Firm* — Myers Wolin, LLC

(57) ABSTRACT

Each color image is decomposed into at least one series of at least three successive primary images of different primary colors which are successively displayed by modulating the activation duration of the pixels of an imaging device. According to the invention, the distribution of the pixel activation phases in the three successive subframes is contracted: the pixel activation periods of the first primary image are shifted toward the end of the subframe of this first image, and, during the subframe of the third primary image, the pixel activation periods of this third primary image are shifted toward the beginning of the subframe of this third image. Color break-up faults are thus advantageously reduced.

9 Claims, 4 Drawing Sheets

METHODS FOR SEQUENTIAL COLOR DISPLAY BY MODULATION OF PULSES

This application claims the benefit, under 35 U.S.C. §365 of International Application PCT/EP2007/055065, filed May 24, 2007, which was published in accordance with PCT Article 21(2) on Dec. 6, 2007 in French and which claims the benefit of French patent application No. 0604798, filed May 30, 2006.

The invention relates to a method of displaying a sequence of color images using an imaging device equipped with a two-dimensional matrix of activatable pixels. Each of the images can be decomposed into at least one series of at least three primary images of different primary colors. In order to display any color image from this sequence, the pixels of the three primary images from this series are successively displayed by modulating the activation duration of said corresponding pixels of the imaging device. Documents U.S. Pat. Nos. 6,392,656, 6,972,736 and 6,756,956 describe such a method.

In this method the beginning of the activation of the pixels of each primary image generally occurs at the beginning of the display of this image. The time interval that is then generated between displaying these primary images generates color break-up faults.

One aim of the invention is to limit this kind of fault.

To this end, the subject of the invention is a method of displaying a sequence of color images using an imaging device equipped with a two-dimensional matrix of activatable pixels in which, in order to display at least one color image from said sequence, said image being decomposed into at least one series of at least three successive primary images of different primary colors, the pixels of said three primary images from at least one series are successively displayed by modulating the activation duration of said corresponding pixels of the imaging device, in which method, for each series having a duration $T_R$, if the following definitions are made for each pixel $P_{ij}$ of said color image:

- $d_{1\text{-}Pij}$, $d_{2\text{-}Pij}$, $d_{3\text{-}Pij}$ as the activation durations of said pixel for the display of the first, second and third primary image, respectively, of said series;
- $d_{Off\text{-}12\text{-}Pij}$ as the time interval between the end $t_{Off\text{-}1\text{-}Pij}$ of activation of said pixel $P_{ij}$ for displaying said first primary image from said series and the beginning $t_{On\text{-}2\text{-}Pij}$ of activation of the same pixel $P_{ij}$ for displaying said second primary image from the same series; and
- $d_{Off\text{-}23\text{-}Pij}$ as the time interval between the end $t_{Off\text{-}2\text{-}Pij}$ of activation of said pixel $P_{ij}$ for displaying said second primary image from said series and the beginning $t_{On\text{-}3\text{-}Pij}$ of activation of the same pixel $P_{ij}$ for displaying said third primary image from the same series;

then, for any said pixel $P_{ij}$ of the imaging device and for each series, the following relation holds:

$$(d_{Off\text{-}12\text{-}Pij}+d_{Off\text{-}23\text{-}Pij})<[T_R-(d_{1\text{-}Pij}+d_{2\text{-}Pij}+d_{3\text{-}Pij})]/2.$$

Advantageously, said relation is applicable for each of the images to be displayed from said sequence. In the case in which the images of the video sequence are decomposed into a plurality of series of at least three successive primary images, the invention applies to each of these series. The series may have identical or different durations.

The display of an image from this sequence is obtained by successively displaying three subframes of different primary colors, generally red, green and blue. In the prior art, the pixel activation phases are generally positioned in the same way whatever the primary image to be displayed, for example either at the beginning of the subframe or in the middle of the subframe. The identical positioning of the activation phases implies the following relation: $(d_{Off\text{-}12\text{-}Pij}+d_{Off\text{-}23\text{-}Pij})\leqq[T_R-(d_{1\text{-}Pij}+d_{2\text{-}Pij}+d_{3\text{-}Pij})]/2$. According to the invention, so as to reduce color break-up faults, the distribution of the pixel activation phases in three successive subframes from the same series is contracted in relation to the prior art: the pixel activation periods of the first primary image are shifted toward the end of the subframe of this first image, and, during the subframe of the third primary image, the pixel activation periods of this third primary image are shifted toward the beginning of the subframe of this third image. Color break-up faults in displaying the video sequence are thus advantageously reduced.

It is to be noted that in document U.S. Pat. No. 6,570,554:

- the display of pixels is not carried out by modulating the activation duration of these pixels as in the invention, but by modulating the amplitude of the backlighting;
- the "black" periods $d_{Off\text{-}12\text{-}Pij}$, $d_{Off\text{-}23\text{-}Pij}$ between activation of the same pixel of different primary images from the same series (i.e. from the same frame) are identical (see the distances $d_{Off\text{-}12\text{-}Pij}$ between successive Rs and Gs on the one hand and $d_{Off\text{-}23\text{-}Pij}$ between successive Gs and Bs on the other hand in FIGS. 4C, 10C, 12C);
- the black periods at the end of the frame in FIGS. 10C, 12C do not correspond to a time interval between the end of activation of a pixel for displaying a primary image and the start of the activation of the same pixel for displaying another primary image from the same series (or same frame), but from another series (or another frame).

It is also to be noted that the term "pixel activation" here leads to the emission of this pixel (upstream of a liquid crystal cell, for example) and cannot, as in U.S. Pat. No. 6,570,554, designate the activation of the backlighting of a liquid crystal cell.

Preferably, if $T_{S2}$ is the maximum admissible duration of pixel activation of said imaging device during the display of the second primary image, then, for any said pixel $P_{ij}$, the following relation holds: $(d_{Off\text{-}12\text{-}Pij}+d_{Off\text{-}23\text{-}Pij}+d_{2\text{-}Pij})\leqq T_{S2}$. Advantageously, said relation is applicable for each of the images to be displayed from said sequence.

According to this advantageous variant, during the subframe of the first primary image, all the pixel activation pulses preferably end at the end of this subframe, and, during the subframe of the third primary image, all the pixel activation pulses preferably start at the beginning of this subframe. Color break-up faults in displaying the video sequence are thus reduced even more.

According to a first preferred variant, it furthermore holds that: $d_{Off\text{-}12\text{-}Pij}=d_{Off\text{-}23\text{-}Pij}$. This relation then applies to each pixel $P_{ij}$ of color images from said sequence, for each series of at least three primary images intended to display each of these images. This relation implies that, for each series, the pixel activation phases for displaying the second primary image are centered relative to the pixel activation phases for displaying the first and the third primary image of this series.

According to another preferred variant, it furthermore holds that: $d_{Off\text{-}12\text{-}Pij}=0$ and/or $d_{Off\text{-}23\text{-}Pij}=0$. This relation then applies to each pixel Pij of color images from said sequence, for each series of at least three primary images intended to display each of these images. This relation implies that, for each series, the pixel activation phases for displaying the second primary image are placed alongside the pixel activation phase for displaying the first or the third primary image of this series.

The hue of the primary color associated with said second primary image is preferably green. The other primary colors, that of the first image and that of the second image, are preferably red and blue. Thus, according to the invention, it is the red and blue subframes that get closer to the green subframe, in order to reduce, in particular, color break-up faults.

The subject of the invention is also an image display system comprising a matrix imaging device equipped with a two-dimensional matrix of activatable pixels and means for activating said pixels which are suitable for applying the method according to the invention.

The activatable pixels of said imaging device are preferably formed by electro-optical valves, and the system furthermore comprises means for successively illuminating said imaging device with each primary color. For the display of each primary image, the imaging device is hence illuminated by the corresponding primary color coming from the illumination means. The duration of illumination of each primary color is hence the maximum admissible duration of pixel activation of the imaging device during the display of the primary image corresponding to this primary color.

Said illumination means preferably comprise a light source emitting said three primary colors, optical means for directing the light emitted by this source onto the matrix of electro-optical valves of said imaging device and a color wheel that is placed in the path of this light between said source and said imaging device and which comprises colored filter segments, each filter being suited to transmit one of the various primary colors emitted by the source. The rotation of the color wheel thus enables successive illumination of the imaging device by each primary color.

The system preferably comprises a projection lens that is suitable and positioned for producing the image of said imaging device on a projection area. This projection area is generally formed by a projection screen which may, optionally, be integrated in the system (case of backprojectors).

The invention will be better understood on reading the following description, given by way of nonlimiting example and with reference to the appended figures in which:

FIG. 1 schematically illustrates an embodiment of an image display system enabling the use of the method according to the invention;

Figure 3:
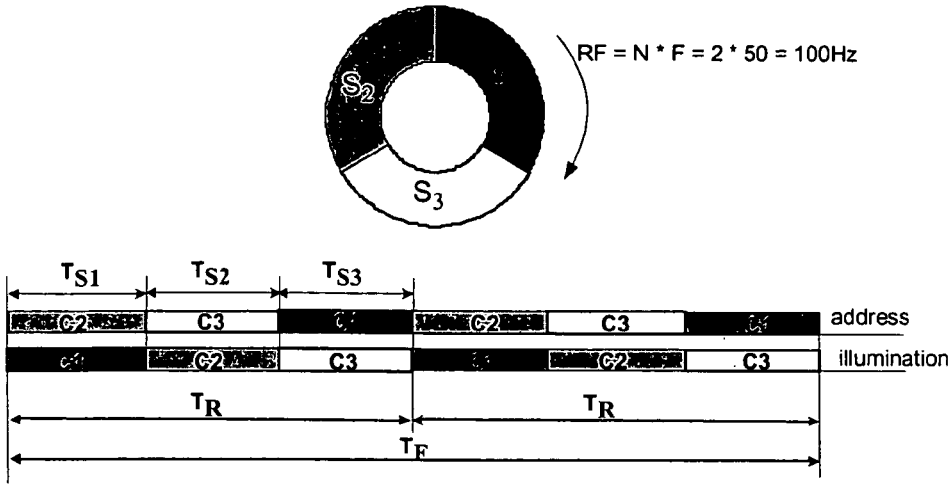
FIG. 3 represents the color wheel of the image display system of FIG. 1 and the splitting of the duration $T_F$ of an image frame into two periods $T_R$ of rotation of this wheel, these themselves being subdivided into three phases 1, 2 and 3 of illumination by different primary colors, of respective durations $T_{S1}$, $T_{S2}$ and $T_{S3}$.
Figure 4:
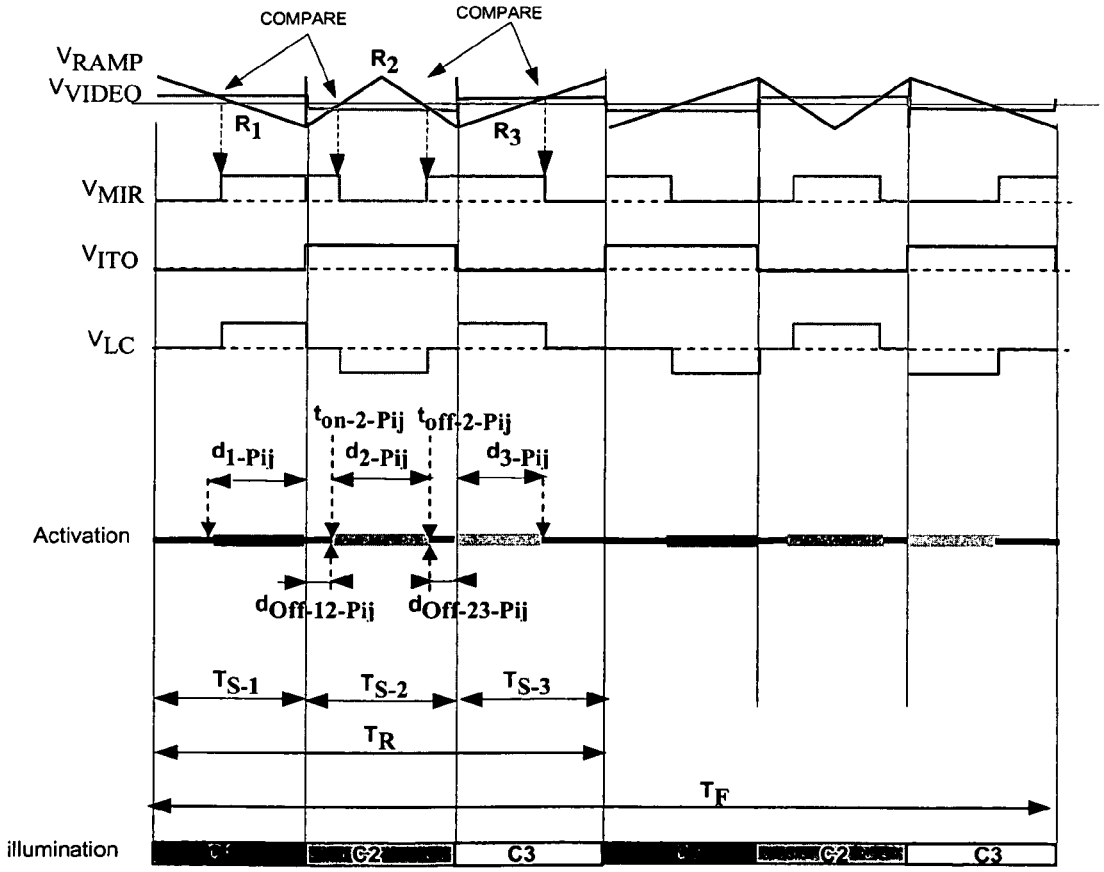
Figure 5:
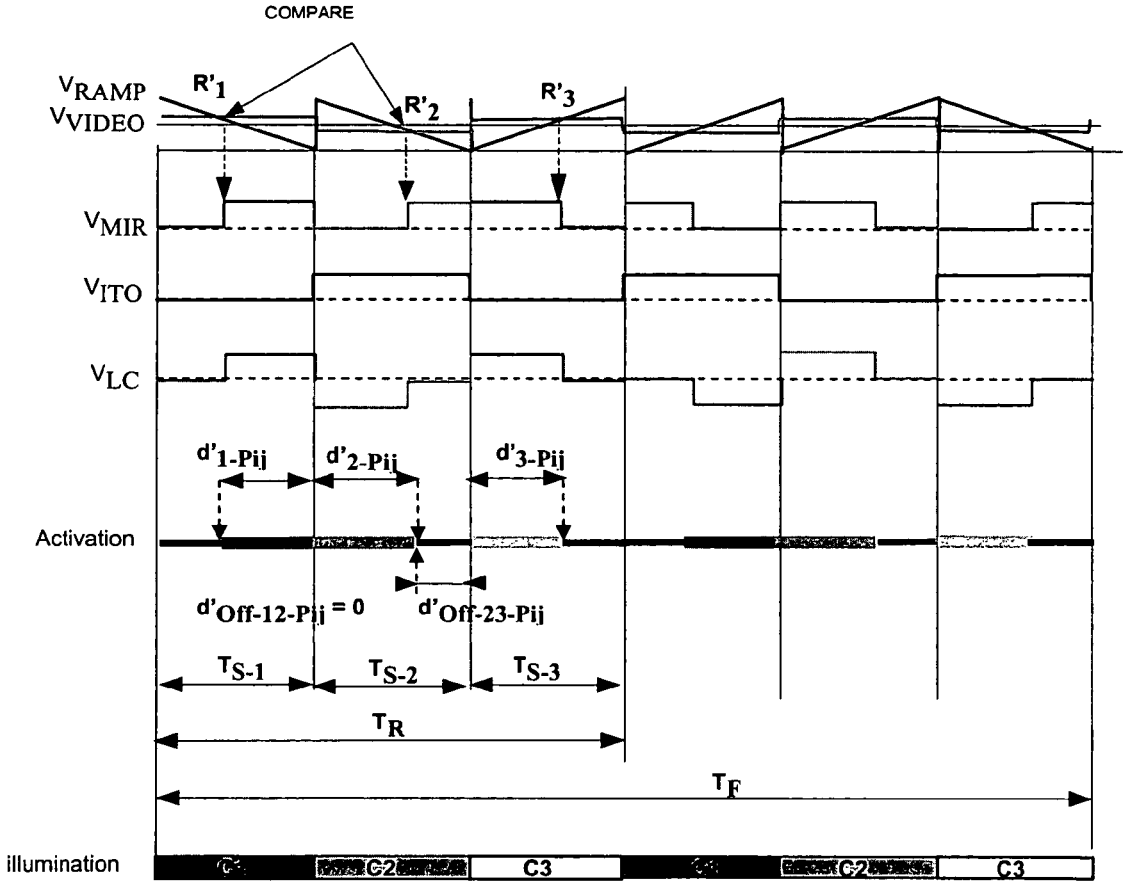
Figure 6:
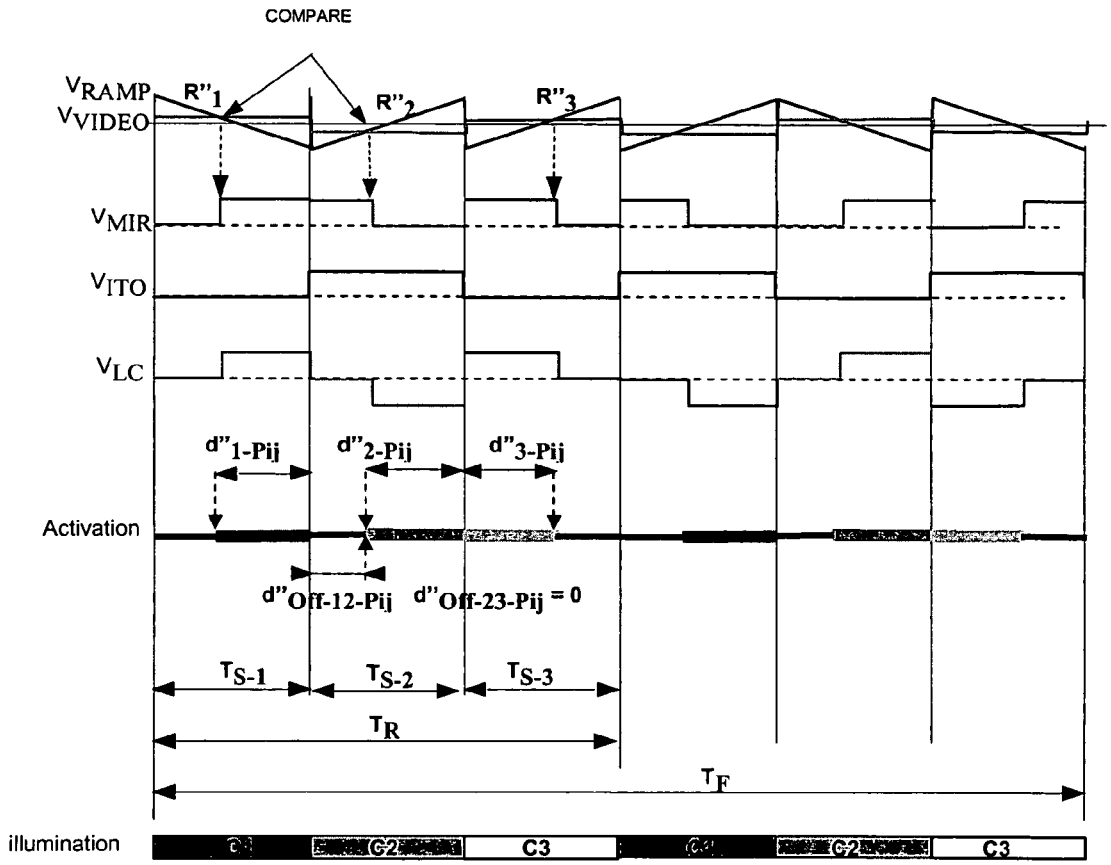

FIG. 4 represents, for the same pixel of a color image to be displayed by a first implementation of the method according to the invention, the following time charts: video signal $V_{VIDEO}$ and reference signal $V_{RAMP}$, voltage $V_{MIR}$ applied to the lower electrode of the light valve corresponding to this pixel, voltage $V_{ITO}$ applied to the upper electrode of this same light valve, potential difference between the electrodes of this valve, staggering of the activation phases of this valve resulting therefrom, and staggering of the illumination phases of this valve in accordance with FIG. 3; and FIGS. 5 and 6 represent the same time charts for the same pixel of a color image to be displayed, respectively, by a second and a third implementation of the method according to the invention.

The figures representing the time charts do not take into account the scale of the values so as to show better some details that would not be clearly apparent if the proportions had been respected.

Figure 1:
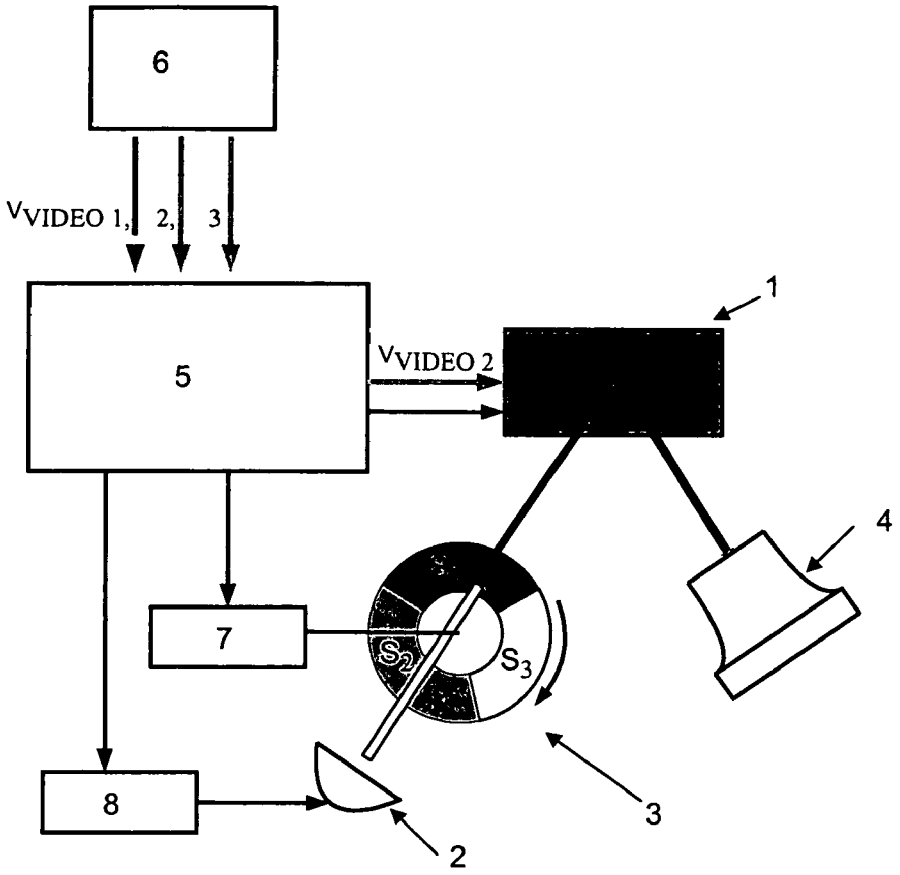
Figure 2:
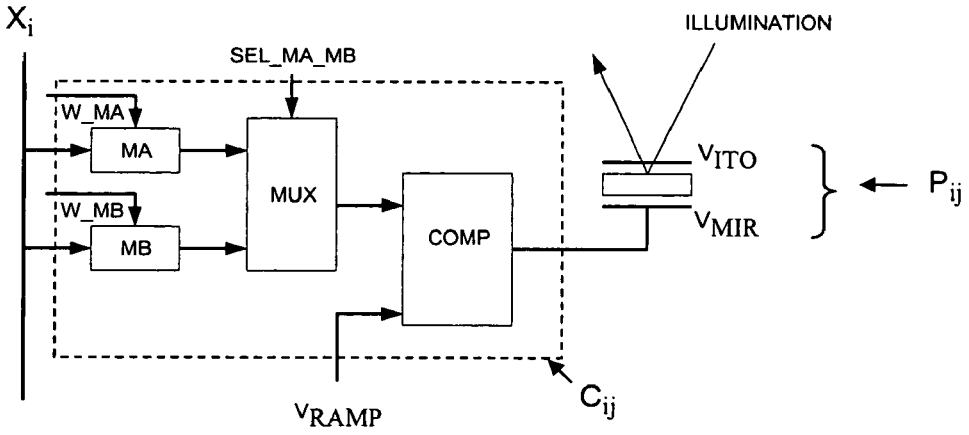
FIG. 2 represents a pixel control circuit of the imaging device for the image display system of FIG. 1.

An embodiment of the image display system according to the invention will now be described with reference to FIG. 1. This system comprises:

- a matrix imaging device 1 comprising a two-dimensional matrix of active pixels $P_{ij}$, here liquid crystal valves; these pixels are divided into columns i and rows j; as illustrated in FIG. 2, each valve comprises a liquid crystal cell LC inserted between a transparent upper electrode ITO and a reflecting lower electrode MIR; the transparent upper electrode is common to all the valves of the imaging device;
- illumination means of this imaging device comprising a light source 2 fed by an electrical power supply 8 and emitting three primary colors, identified C1 for the color red, C2 for the color green and C3 for the color blue, optical means (not shown) for directing the light emitted by this source onto the matrix of liquid crystal valves of the imaging device 1, and a color wheel 3 placed in the path of the beam from the source illuminating the imaging device; the color wheel 3 comprises three segments $S_1$, $S_2$, $S_3$ of colored filters respectively allowing the first (red), second (green) and third (blue) primary colors emitted by the source 2 to pass; this color wheel is driven by a motor 7 so as to be able to illuminate the imaging device 3 successively with each primary color during one rotation of this wheel; the rotation time of this wheel is called $T_R$;
- a projection lens 4 that is suitable and positioned for producing the image of the imaging device 1 on a projection area (not shown);
- means for controlling the system 5 that, associated with activation means for each light valve $C_{ij}$ represented in FIG. 2, enable control of the activation of the pixels $P_{ij}$ of the imaging device, of the light source 2 through its power supply 8, and the rotation of the color wheel 3 through its drive motor 7; and
- an input interface 6 capable of receiving video signals representing images from a video sequence and of decomposing each image into two series of three primary images, a first red-colored primary image, a second green-colored primary image, and a third blue-colored image.

The angular widths of the colored filter segments $S_1$, $S_2$, $S_3$ of the color wheel 3 are preferably designed, in a way known per se, such that during each rotation of this wheel the illumination durations $T_{S1}$, $T_{S2}$, $T_{S3}$ of the imaging device in each primary color are suited for the fusion of the resultant illuminations to form a white hue. This white hue generally corresponds to a temperature of the target color. This arrangement advantageously makes the most of the light flux emitted by the source 2. For convenience, it has been chosen here that $T_{S1}=T_{S2}=T_{S3}$.

With reference to FIG. 2, the matrix imaging device 1 furthermore comprises an array of control circuits, thus forming what is called an active matrix, with each circuit intended to control one pixel. Each circuit $C_{ij}$ that controls a pixel $P_{ij}$ comprises:

- two memories MA, MB suitable for storing a piece of video data $V_{video}$ representing the corresponding pixel of a primary image to be displayed;
- a multiplexer MUX connected to the two memories MA, MB that is suitable for selecting the content of one memory or the other;
- a comparator COMP connected to the output from the multiplexer MUX and to a reference input RAMP of the circuit, suitable for comparing the content $V_{video}$ of the memory selected by the multiplexer MUX and the signal $V_{RAMP}$ applied at the reference input RAMP so as to deliver an output signal $V_{MIR}$ of high value $V_{MIR-H}$ or low value $V_{MIR-L}$ according to the following logic: if $V_{video}>V_{RAMP}$, then $V_{MIR}=V_{MIR-H}$, otherwise $V_{MIR}=V_{MIR-L}$. The output from this comparator is connected to the reflecting lower electrode MIR of the pixel $P_{ij}$.

Each control circuit $C_{ij}$ therefore comprises the following inputs:

- memory inputs, already described, connected to electrodes from columns $X_i$;
- access controls W_MA and W_MB controlling access to the memories MA and MB, connected to electrodes from rows (not shown); thus all the control circuits $C_{ij}$ from the same row j share these access controls;
- a memory selection control SEL_MA_MB and a reference input RAMP, already described, each connected to an electrode common to the panel; thus all the control circuits $C_{ij}$ of the imaging device 1 share the same memory selection control and the same reference signal;

A first implementation will now be described of the method according to the invention for displaying a sequence of images using the image display system that has just been described.

The duration $T_F$ of each image of this sequence, or the image frame duration, is here divided into two series of three primary images; each series of three primary images corresponds to a period $T_R$ of rotation of the color wheel. As previously indicated, the time allocated for illumination of the imaging device by each primary color during one turn of the color wheel is here $T_{S1}=T_{S2}=T_{S3}$; hence $T_R=T_{S1}+T_{S2}+T_{S3}$ and $T_F=2\times T_R$; for example, $T_F=20$ ms.

The input interface 6 delivers to the control means 5 series of three primary images. Each primary image is delivered in the form of a video signal for each pixel of this image to be displayed. With reference to FIG. 3, during the display of a first primary image of a series, thanks to the control means, the video signals for the display of pixels of the second primary image, which is to be displayed immediately after the first in the course of displaying, are loaded into the memories MA or MB of each pixel control circuit. This loading proceeds, for example, by selecting each row of pixels of the imaging device and, once a row has been selected, opening access to the memories MA of each pixel control circuit of this row using the access control, for example W_MA, of the memories MA, and, using electrodes of column Xi, consigning to these memories the values of video data of pixels of the corresponding row from the image to be displayed. When the entire second primary image to be displayed is stored in this way in the active matrix of the imaging device and when the duration $T_{S1}$ of illumination in the first primary color has elapsed, delivery of these video signals $V_{VIDEO}$ by the multiplexers MUX to one of the inputs of the comparators COMP is triggered using the memory selection control SEL_MA_MB. At the same time a ramp signal $V_{RAMP}=R_2$ is sent to the reference input RAMP of these comparators COMP, as represented in the upper graph of FIG. 4. Here this is a signal linearly increasing during the first half of the phase of illuminating the imaging device in the second primary color, then linearly decreasing during the second half of this illumination phase. While the imaging device is now illuminated by the second primary color, each control circuit comparator $C_{ij}$ compares the signals $V_{VIDEO}$ and $V_{RAMP}$ and delivers a logic signal $V_{MIR}$. The form of the ramp signal $V_{AMP}=R_2$ here implies, as illustrated in the second graph of FIG. 4, a centering of the pixel activation phases, of duration $d_{2-Pij}$, over the phase of illuminating the imaging device with the second primary color, of duration $T_{S2}$. The third graph of FIG. 4 shows the value of the potential $V_{ITO}$ applied at the transparent upper electrode of the electro-optical valves: this potential is here equal to $V_{MIR-H}$. The fourth graph of FIG. 4 shows the voltage $V_{LC}$ applied to the terminals of the light valves, which is equal to $V_{MIR-VITO}$.

For each series of primary images to be displayed, the display of the first and third primary image is obtained according to the same method, extrapolated from the method of displaying the second primary image. The upper graph of FIG. 4 shows the signal $V_{RAMP}=R_1$ applied when displaying the first primary image, which is linearly decreasing, and the signal $V_{RAMP}=R_3$ applied when displaying the third primary image, which is linearly decreasing. The "activation" graph of FIG. 4 shows the staggering of the resultant three pixel activation periods. It can be seen that:

- the end of the activation phases of all the pixels of the first primary image of each series coincides with the end of the phase of illuminating the imaging device with the first primary image; and
- the start of the activation phases of all the pixels of the third primary image of each series coincides with the start of the phase of illuminating the imaging device with the third primary image.

Thus, if the following definitions are made for each pixel $P_{ij}$ of the color image to be displayed:

- $d_{1-Pij}$, $d_{2-Pij}$, $d_{3-Pij}$ as the activation durations of this pixel for the display of the first, second and third primary image, respectively, of said series;
- $d_{Off-12-Pij}$ as the time interval between the end $t_{Off-1-Pij}$ of activation of this pixel $P_{ij}$ for displaying the first primary image and the beginning $t_{On-2-Pij}$ of activation of the same pixel $P_{ij}$ for displaying this second primary image; and
- $d_{Off-23-Pij}$ as the time interval between the end $t_{Off-2-Pij}$ of activation of this pixel $P_{ij}$ for displaying the second primary image and the beginning $t_{On-3-Pij}$ of activation of the same pixel $P_{ij}$ for displaying the third primary image;

it is observed that:

- the following relation holds: $d_{Off-12-Pij}+d_{2-Pij}+d_{Off-23-Pij}=T_{S2}$; and
- due to the centering of the pixel activation phases for displaying the second primary images of each series, it holds that $d_{Off-12-Pij}=d_{Off-23-Pij}$.

The control method that has just been described enables a substantial reduction in color break-up faults for the display of video sequences.

It should be noted that the use of ramp-shaped reference signals for controlling the modulation of the emission duration of pixels of an imaging device is described in the prior art, for example in document US2001-026261.

A second implementation will now be described of the method according to the invention, again for displaying a sequence of images using the image display system that has just been described.

The only difference to the first method that has just been described lies in the form of the reference signal $V_{RAMP}$. Here, in each series of three primary images, instead of the previous succession $R_1$, $R_2$, $R_3$, there is now, with reference to FIG. 5, the succession $R'_1$: linearly decreasing, $R'_2$: again linearly decreasing, and $R'_3$: linearly increasing so that the time interval $d'_{Off-12-Pij}$ between the end of activation of each pixel $P_{ij}$ for displaying the first, red, primary image and the start of activation of the same pixel $P_{ij}$ for displaying the second, green, primary image is always zero. The relation $(d'_{Off-12-Pij}=0)+d'_{2-Pij}+d'_{Off-23-Pij}=T_{S2}$ still holds. In this embodiment the activation phases of all the pixels of the first, red, primary image are placed alongside the activation phases of all the pixels of the second, green, primary image. A substantial reduction in color break-up faults for the display of video sequences is again obtained.

A third implementation will now be described of the method according to the invention, again for displaying a sequence of images using the same image display system. The only difference to the first method again lies in the form of the reference signal $V_{RAMP}$. Here, in each series of three primary images, instead of the succession $R_1$, $R_2$, $R_3$ of the first embodiment, there is now, with reference to FIG. 6, the succession $R''_1=R'_1$: linearly decreasing, $R''_2$: linearly increasing, and $R''_3=R'_3$: linearly increasing so that the time interval $d''_{Off\text{-}23\text{-}Pij}$ between the end of activation of each pixel $P_{ij}$ for displaying the second, green, primary image and the start of activation of the same pixel $P_{ij}$ for displaying the third, blue, primary image is always zero. The relation $d''_{Off\text{-}12\text{-}Pij}+d''_{2\text{-}Pij}+(d''_{Off\text{-}23\text{-}Pij}=0)=T_{S2}$ still holds. In this embodiment the activation phases of all the pixels of the second, green, primary image are placed alongside the activation phases of all the pixels of the third, blue, primary image. A substantial reduction in color break-up faults for the display of video sequences is again obtained.

Although it holds that $d_{Off\text{-}12\text{-}Pij}+d_{2\text{-}Pij}+d_{Off\text{-}23\text{-}Pij}=T_{S2}$ in all the embodiments presented, the invention also includes the cases in which $d_{Off\text{-}12\text{-}Pij}+d_{2\text{-}Pij}+d_{Off\text{-}23\text{-}Pij}<T_{S2}$.

Although in all the embodiments presented the pixel activation phases of the first primary image from each series always end at the same time as the phase of illuminating the imaging device with this primary color, and the pixel activation phases of the third primary image always start at the same time as the phase of illuminating the imaging device with this primary color, the invention includes cases in which the end or the start of these phases do not coincide, provided the following relation is satisfied: $(d_{Off\text{-}12\text{-}Pij}+d_{Off\text{-}23\text{-}Pij})<[T_R-(d_{i\text{-}Pij}+d_{2\text{-}Pij}+d_{3\text{-}Pij})]/2$. It should be noted that this relation is obviously satisfied in all the embodiments that have just been presented.

The invention has been described with reference to a decomposition of each image of a video sequence into two series of three successive primary images of different primary colors. The invention also applies to cases of decomposition of each image into a single series of three primary images, or into more than two series of three primary images. The various series may have different durations.

The invention also applies to cases in which each series has a number of primary images greater than three, provided that there are three of them successively in each series in order to apply the method according to the invention. By extension, among the primary colors, a color of white hue may even be counted.

The invention has been described with reference to an image display system in which the sequencing of primary images is ensured by a color wheel. Other modes of sequencing primary images may be used without departing from the invention.

The invention has been described with reference to a system for image display by projection in which the active pixels of the imaging device are liquid crystal valves. Other active pixels may be used without departing from the invention, such as micromirror pixels (DMD) or pixels with light-emitting diodes, especially when they are controllable by pulse-width modulation in an analogous manner, as described for example in document U.S. Pat. No. 6,590,549. It should be noted that in document WO2006/003091 the micromirrors are not controllable in an analogous manner.

The invention has been described with reference to a system for image display by projection. Other image display systems may be used for implementing the invention.

The invention claimed is:

1. A method of displaying a sequence of color images using an imaging device equipped with a two-dimensional matrix of activatable pixels in which, in order to display at least one color image from said sequence, said image being decomposed into at least one series of at least three successive primary images of different primary colors, the pixels of said three primary images from at least one series are successively displayed by modulating the activation duration of said corresponding pixels of the imaging device, wherein, for each series having a duration $T_R$, if the following definitions are made for each pixel $P_{ij}$ of said color image:

$d_{1\text{-}Pij}$, $d_{2\text{-}Pij}$, $d_{3\text{-}Pij}$ as the activation durations of said pixel for the display of the first, second and third primary image, respectively, of said series;

$d_{Off\text{-}12\text{-}Pij}$ as the time interval between the end $t_{Off\text{-}2\text{-}Pij}$ of activation of said pixel $P_{ij}$ for displaying said first primary image from said series and the beginning $t_{On\text{-}2\text{-}Pij}$ of activation of the same pixel $P_{ij}$ for displaying said second primary image from the same series; and $d_{Off\text{-}23\text{-}Pij}$ as the time interval between the end $t_{Off\text{-}2\text{-}Pij}$ of activation of said pixel $P_{ij}$ for displaying said second primary image from said series and the beginning $t_{On\text{-}3\text{-}Pij}$ of activation of the same pixel $P_{ij}$ for displaying said third primary image from the same series;

then, for any said pixel $P_{ij}$ of the imaging device and for each series, the method comprising: selecting the values of $d_{Off\text{-}12\text{-}Pij}$ and $d_{Off\text{-}23\text{-}Pij}$ so that the following relation holds: $(d_{Off\text{-}12\text{-}pij}+d_{Off\text{-}23\text{-}Pij})<[T_R-(d_{1\text{-}Pij}+d_{2\text{-}Pij}+d_{3\text{-}Pij})]/2$.

2. The method as claimed in claim 1, wherein if $T_{S2}$ is the maximum admissible duration of pixel activation of said imaging device during the display of the second primary image, then, for any said pixel $P_{ij}$, the selecting further based on that the following relation holds: $(d_{Off\text{-}12\text{-}Pij}+d_{Off\text{-}23\text{-}Pij}+d_{2\text{-}Pij})\leqq T_{S2}$.

3. The method as claimed in claim 1, wherein the selecting is furthermore based on that the following relation holds: $d_{Off\text{-}12\text{-}Pij}=d_{Off\text{-}23\text{-}Pij}$.

4. The method as claimed in claim 1, wherein the selecting is furthermore based on that the following relation holds: $d_{Off\text{-}12\text{-}Pij}=0$ and/or $d_{Off\text{-}23\text{-}Pij}=0$.

5. The method as claimed in claim 1, wherein the hue of the primary color associated with said second primary image is green.

6. An image display system for displaying a sequence of color images, the system comprising a matrix imaging device equipped with a two-dimensional matrix of activatable pixels and means for activating said pixels, in order to display at least one color image from said sequence, said imaging device is configured to decompose said image into at least one series of at least three successive primary images of different primary colors, the pixels of said three primary images from at least one series are successively displayed by modulating the activation duration of said corresponding pixels of the imaging device, wherein, for each series having a duration $T_R$, if the following definitions are made for each pixel $P_{ij}$ of said color image:

$d_{1\text{-}Pij}$, $d_{2\text{-}Pij}$, $d_{3\text{-}Pij}$ as the activation durations of said pixel for the display of the first, second and third primary image, respectively, of said series;

$d_{Off\text{-}12\text{-}Pij}$ as the time interval between the end $t_{Off\text{-}2\text{-}Pij}$ of activation of said pixel $P_{ij}$ for displaying in said first primary image from said series and the beginning $t_{On\text{-}2\text{-}Pij}$ of activation of the same pixel $P_{ij}$ for displaying said second primary image from the same series; and $d_{Off\text{-}23\text{-}Pij}$ as the time interval between the end $t_{Off\text{-}2\text{-}Pij}$ of activation of said pixel $P_{ij}$ for displaying said second primary image from said series and the beginning $t_{On\text{-}3\text{-}Pij}$ of activation of the same pixel $P_{ij}$ for displaying said third primary image from the same series:

then, for any said pixel $P_{ij}$ of the imaging device and for each series, the means for activating said pixel is configured to select the values of $d_{Off\text{-}12\text{-}Pij}$ and $d_{Off\text{-}23\text{-}Pij}$ so that the following relation holds: $(d_{Off\text{-}12\text{-}Pij}+d_{Off\text{-}23\text{-}Pij})<[T_R-(d_{1\text{-}Pij}+d_{2\text{-}Pij}+d_{3\text{-}Pij})]/2$.

7. The system as claimed in claim 6, in which the activatable pixels of said imaging device are formed by electro-optical valves, wherein the system furthermore comprises means for successively illuminating said imaging device with each primary color.

8. The system as claimed in claim 7, wherein said illumination means comprise a light source emitting said three primary colors, optical means for directing the light emitted by this source onto the matrix of electro-optical valves of said imaging device and a color wheel that is placed in the path of this light between said source and said imaging device and which comprises colored filter segments each filter being suited to transmit one of the various primary colors emitted by the source.

9. The system as claimed in claim 7, wherein the system further comprises a projection lens that is suitable and positioned for producing the image of said imaging device on a projection area.

* * * * *